US010934142B2

(12) United States Patent
Hall et al.

(10) Patent No.: US 10,934,142 B2
(45) Date of Patent: Mar. 2, 2021

(54) MOTOR-DRIVEN FAIRLEAD FOR ASSISTING SPOOLING OR UNSPOOLING FROM A WINCH

(71) Applicant: HALL LABS LLC, Provo, UT (US)

(72) Inventors: David R. Hall, Provo, UT (US); Daniel Madsen, Vineyard, UT (US); Jerome Miles, Spanish Fork, UT (US); Dustin Clouse, Springville, UT (US)

(73) Assignee: Hall Labs LLC, Provo, UT (US)

( * ) Notice: Subject to any disclaimer, the term of this patent is extended or adjusted under 35 U.S.C. 154(b) by 43 days.

(21) Appl. No.: 16/180,987

(22) Filed: Nov. 5, 2018

(65) Prior Publication Data

US 2019/0263640 A1 Aug. 29, 2019

Related U.S. Application Data

(60) Provisional application No. 62/635,659, filed on Feb. 27, 2018.

(51) Int. Cl.

| | |
|---|---|
| ***B66D 1/54*** | (2006.01) |
| ***G08B 5/36*** | (2006.01) |
| ***B66D 1/36*** | (2006.01) |
| ***B66D 1/38*** | (2006.01) |
| ***B66D 1/50*** | (2006.01) |
| ***G08B 21/18*** | (2006.01) |

(52) U.S. Cl.

CPC ..... *B66D 1/54* (2013.01); *B66D 1/36* (2013.01); *B66D 1/38* (2013.01); *B66D 1/505* (2013.01); *G08B 5/36* (2013.01); *G08B 21/182* (2013.01)

(58) Field of Classification Search

CPC ... B66D 1/36; B66D 1/38; B66D 1/40; B66D 1/46; B66D 1/50; B66D 1/54; B66D 1/505; B66D 2700/0191; G08B 5/36; G08B 21/182

See application file for complete search history.

(56) References Cited

U.S. PATENT DOCUMENTS

| | | | | | |
|---|---|---|---|---|---|
| 2,396,958 | A * | 3/1946 | Mackmann | B66D 1/36 | 242/483.4 |
| 3,565,402 | A * | 2/1971 | Linke | B66D 1/56 | 254/269 |
| 4,015,798 | A * | 4/1977 | Benya | B66D 1/38 | 242/157.1 |
| 4,235,394 | A * | 11/1980 | Fry | B65H 54/2854 | 242/397.3 |
| 4,455,961 | A * | 6/1984 | Hansen | B66D 1/38 | 114/242 |
| 4,475,163 | A * | 10/1984 | Chandler | B66D 1/505 | 377/17 |

(Continued)

*Primary Examiner* — Michael E Gallion

(57) ABSTRACT

A fairlead for use with a winch is disclosed. The fairlead is made up of a first and second roller, a motor, a sensor, and a controller. The rollers are adapted to aid in spooling or unspooling a line. The motor drives at least the first roller. The sensor determines whether a winch drum is spooling or unspooling a line. The controller is connected to the motor and communicates with the sensor. The sensor determines whether the winch drum is spooling or unspooling the line. The controller is configured to direct the motor so that the rollers assist in unspooling or spooling the line in coordination with the winch drum. In some embodiments, the fairlead is integrated into the winch.

17 Claims, 7 Drawing Sheets

(56) References Cited

U.S. PATENT DOCUMENTS

| | | | | | |
|---|---|---|---|---|---|
| 4,655,399 | A * | 4/1987 | Harvey | A01G 25/095 | 137/355.21 |
| 5,965,994 | A * | 10/1999 | Seo, II | B66D 1/46 | 212/307 |
| 6,811,112 | B1 * | 11/2004 | Currie | B65H 54/2872 | 242/157.1 |
| 9,248,999 | B2 * | 2/2016 | Xydias | B66D 1/38 | |
| 9,783,399 | B2 * | 10/2017 | Hausladen | B66D 1/30 | |
| 10,280,051 | B2 * | 5/2019 | Hall | B66D 1/38 | |
| 10,294,087 | B2 * | 5/2019 | Hall | B66D 1/38 | |
| 10,519,013 | B2 * | 12/2019 | Curran | B66D 1/36 | |
| 10,544,017 | B2 * | 1/2020 | Hall | B66D 1/365 | |
| 2003/0141400 | A1 * | 7/2003 | D'Ottavi | H01B 13/0285 | 242/418 |
| 2005/0087644 | A1 * | 4/2005 | Kim | B65H 75/425 | 242/390.8 |
| 2015/0266707 | A1 * | 9/2015 | Holmberg | B66D 1/12 | 254/362 |
| 2016/0200553 | A1 * | 7/2016 | Sorensen | B66C 13/08 | 212/273 |
| 2016/0236916 | A1 * | 8/2016 | Hall | B66D 1/38 | |
| 2018/0175713 | A1 * | 6/2018 | Fretz | H02K 7/116 | |
| 2019/0263641 | A1 * | 8/2019 | Hall | B66D 1/38 | |

* cited by examiner

MOTOR-DRIVEN FAIRLEAD FOR ASSISTING SPOOLING OR UNSPOOLING FROM A WINCH

CROSS-REFERENCE TO RELATED APPLICATIONS

This application is a continuation-in-part of U.S. Provisional Application 62/635,659 filed Feb. 27, 2018, the entire contents of which are incorporated by reference.

TECHNICAL FIELD

The invention relates to winches and fairleads for winches.

BACKGROUND

Winches are valuable tools. Winches help get people unstuck or lift loads. A winch winds a line around a drum. Winches have little to no management of how the cable winds on the drum. Most interaction with the winch cable is traditionally done by hand. On a traditional winch, a user will generally need to disengage the winch drum from the winch gearbox by pulling a lever and entering a "free-spool" mode. A user will then pull the line to unspool the cable from the winch drum by hand.

If a user were to try to unspool the line by pushing the out button, the drum would spin, without the line coming off the drum. Instead, the line would begin to loosen on the drum and become a tangled mess.

Guiding the line back onto the winch drum of traditional winches is also done by hand. If the line is not coiled in an organized even way, with no gaps between the coils of line, the line may not fit on the drum. Additionally, without organized even coiling the line is likely to become tangled the next time it is unspooled. It can be dangerous to guide the line onto the winch drum by hand because debris can get caught in the line and cause damage to a user's hand.

Damage from a winch generally occurs when a winch is overloaded. An overloaded winch will often create excessive heat which can damage the motor, gearbox or winch line. This can then lead to the winch line snapping, thus causing damage to the vehicle the winch is attached to as well as surrounding people.

SUMMARY

In a first aspect, the disclosure provides a fairlead for use with a winch. The fairlead is made up of a first and second roller, a motor, a sensor, and a controller. The rollers are adapted to aid in spooling or unspooling a line. The motor drives at least the first roller. The sensor determines whether a winch drum is spooling or unspooling a line. The controller is connected to the motor and communicates with the sensor. The sensor determines whether the winch drum is spooling or unspooling the line. The controller is configured to direct the motor so that at least the first roller assists in unspooling or spooling the line in coordination with the winch drum.

In a second aspect, the disclosure provides a fairlead for attaching to a winch. The fairlead is made up of a first and second roller, a motor, a sensor, and a controller. The motor drives at least the first roller. The sensor determines whether a winch drum is spooling or unspooling a line. The controller is connected to the motor and communicates with the sensor. The rollers are adapted to help unspool a line off of and spool a line onto the winch drum. The controller is configured to control the motor to drive at least the first roller in the direction so as to pull on the line as it is unspooling from the winch drum and to disengage the rollers when the line is spooling onto the winch drum.

In a third aspect, the disclosure provides a winch. The winch is made up of a winch and fairlead. The winch includes a winch motor and a winch drum for spooling and unspooling a line. The fairlead includes a first and second roller, a fairlead motor, a sensor, and a controller. The fairlead motor drives at least the first roller. The sensor determines whether the winch drum is spooling or unspooling a line. The controller is connected to the fairlead motor and in communication with the sensor. The sensor determines whether the winch drum is spooling or unspooling the line. The controller is configured to direct the motor so that at least the first roller assists in unspooling or spooling the line in coordination with the winch drum.

Further aspects and embodiments are provided in the foregoing drawings, detailed description, and claims.

BRIEF DESCRIPTION OF THE DRAWINGS

The following drawings are provided to illustrate certain embodiments described herein. The drawings are merely illustrative and are not intended to limit the scope of claimed inventions and are not intended to show every potential feature or embodiment of the claimed inventions. The drawings are not necessarily drawn to scale; in some instances, certain elements of the drawing may be enlarged with respect to other elements of the drawing for purposes of illustration.

DETAILED DESCRIPTION

Figure 1:
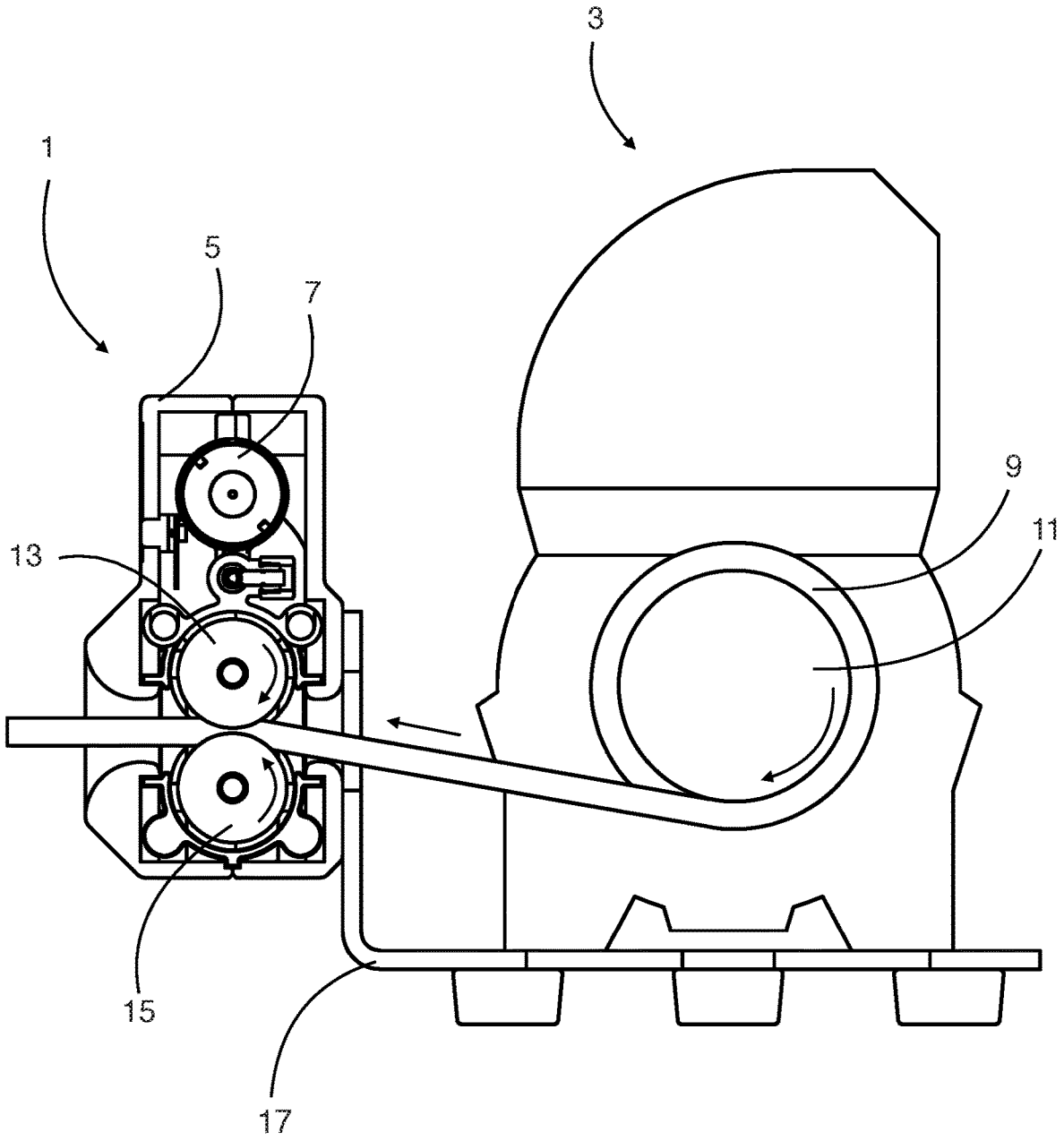
FIG. 1 is a cross-section of the fairlead attached to a winch.

The following description recites various aspects and embodiments of the inventions disclosed herein. No particular embodiment is intended to define the scope of the invention. Rather, the embodiments provide non-limiting examples of various compositions and methods that are included within the scope of the claimed inventions. The description is to be read from the perspective of one of ordinary skill in the art. Therefore, information that is well known to the ordinarily skilled artisan is not necessarily included.

Definitions

The following terms and phrases have the meanings indicated below unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa unless expressly indicated to the contrary.

As used herein, the singular forms "a," "an," and "the" include plural referents unless the context clearly dictates otherwise. For example, reference to "a substituent" encompasses a single substituent as well as two or more substituents, and the like.

As used herein, "for example," "for instance," "such as," or "including" are meant to introduce examples that further clarify more general subject matter. Unless otherwise expressly indicated, such examples are provided only as an aid for understanding embodiments illustrated in the present disclosure and are not meant to be limiting in any fashion. Nor do these phrases indicate any kind of preference for the disclosed embodiment.

As used herein, "personal communication device" is meant to refer to smartphones, tablet computing devices, and laptop computers.

As technology has advanced, improvements in motors and composites have led to advances in winch technology. While improvements have taken place, older technologies are still in use and less expensive models continue to use the older technology. In the area of winches, older less expensive winches use a DC motor that would currently be thought of as basic. This basic DC motor uses permanent magnets. The change in direction of the motor and thus the drum, to spool the cable onto the drum or unspool the cable from the drum, is accomplished by changing the electrical polarity applied to the motor. Effectively, for example, what was a positive voltage for a clockwise rotation to unspool a cable from the drum would then become a negative voltage for a counter-clockwise rotation to spool a cable onto the drum.

The newest high-powered winches utilize a series-wound motor to turn the winch drum. Series-wound motors offer higher start-up torques and do not require permanent magnets. In a series-wound motor, a current will run through the armature on the shaft of the motor (as happens with a basic DC motor) and will also run through windings on the motor stator. The windings are electrical wires (typically copper wire) wound around the motor stator. By running a current through the windings magnetic fields are created. The direction of the current through the windings determines the polarity of the magnetic field. Though the electrical polarity does not change, the current pathway does. A current sensing device is placed to know the direction of the current which leads to knowing the rotational direction of the drum.

This same current sensing device will also work with the basic permanent magnet motor. The change in polarity of a basic permanent magnet motor is effectively a change in the direction of the current.

An alternative to hand guiding a cable off the winch drum is to use a powered fairlead. The powered fairlead such as that described in U.S. Provisional Patent 62/635,659, has a motor to power the rotation of rollers which assist with spooling and unspooling the cable. The powered fairlead also has a line guide to direct the cable spooling and unspooling. It is important to know the direction of rotation of the winch drum so that the fairlead is working with the winch to spool and unspool the line. It would be against the purpose of the fairlead if the rollers of the fairlead were trying to unspool the cable from the drum while the winch was trying to spool the cable onto the drum.

When unspooling the cable from the drum, the fairlead motor must rotate in the correct direction to rotate the rollers and actively pull the cable out and away from the winch drum. The rollers of the fairlead are made of foam or rubber. The line is compressed between the two rollers as it is unspooled and spooled. The material of the rollers and the compression created on the line assist in gripping the line as it is unspooled.

It is important that the line coil onto the winch drum in an organized and even manner. The fairlead helps to accomplish this by integrating an automatic line coiling mechanism into the fairlead.

When spooling the cable onto the drum, the fairlead motor needs to rotate in the opposite direction to assist the winch drum in spooling the cable onto the drum.

Now referring to FIG. 1, which is a cross-section of the fairlead 1 and the winch 3. The winch 3 and fairlead 1 are both attached to a frame 17. The fairlead housing 5 attaches the fairlead 1 to the frame 17. The winch 3 has a drum 9 around which a line 11 is coiled. When the drum 11 rotates to unspool the line 9 as seen by the arrow on the drum indicating the direction of rotation. The line 9 also has arrows to indicate the direction the line 9 is moving. As the line 9 is unspooled from the drum 11, it passes between the upper roller 13 and the lower roller 15 of the fairlead 1. The rollers are designed so that they assist in unspooling the line. The fairlead 1 has a motor which rotates the rollers to assist the line 9 as it unspools from the drum 11 of the winch 3.

To ensure that the rollers 13 and 15 of the fairlead 1 are assisting to unspool the line off the winch, the motor 7 of the fairlead 1 must turn the rollers so that they are unspooling the line 9 in concert with the winch drum 11. The arrow on winch drum 11 indicates the direction of rotation, for the purposes of this example the winch drum 11 is moving in a clockwise direction to unspool the line 9 from the winch drum. The line 9 is unspooling from the drum 11 and moving toward the fairlead 1. The upper roller 13 and lower roller 15 compress the line 9. As the rollers 13 and 15 compress the line 9, they are able to keep tension on the line 9 so that it unspools smoothly. To ensure that the line 9 unspools smoothly the rollers 13 and 15 must rotate in the correct direction. The motor 7 of the fairlead 1 is connected to a microcontroller (not shown) which is connected to a sensor placed in the winch (not shown) to determine the direction of rotation of the winch drum 11. The sensor will be described later. The sensor communicates the direction of rotation of the winch drum 11 to the fairlead motor 7. This enables the fairlead motor 7 to rotate the rollers 13 and 15 in the correct direction to unspool the line. In the present example, the upper roller 13 rotates in a clockwise direction, as shown by the arrow on upper roller 13. At the same time, the lower roller 15 rotates in a counterclockwise direction, as shown by the arrow on the lower roller 15. The rotation of the rollers 13 and 15 keep tension on the line 9 as it is unspooled from the winch drum 11.

The upper roller 13 and lower roller 15 are preferably made of foam or rubber. In other embodiments, the rollers are made of metal. The line 9 is compressed between the upper roller 13 and the lower roller 15. The material of the rollers 13 and 15 along with the compression they exert on the line 9 assist in gripping the line 9 to keep tension on the line 9 as it unspools. It is necessary to coordinate the speed at which the rollers 13 and 15 are turning with the speed at which the winch drum 11 is unspooling the line 9 from the drum. If the fairlead rollers 13 and 15 spin slower than the winch drum 11 is unspooling the line 9, the line 9 will become loose and tangled. If the fairlead rollers 13 and 15 spin faster than the winch drum 11 is unspooling the line 9, friction is generated between the rollers 13 and 15 and the line 9. Friction leads to excessive wear and stress on the fairlead rollers, gears, and motor.

The optimal speed for the rollers 13 and 15 to spin is somewhere between these extremes. It should be fast enough to maintain tension on the line 9 between the winch drum 11 and the rollers 13 and 15, but not so fast that unnecessary friction is generated. The ideal unspooling rope tension can be found when the fairlead overdrives the line 9. This means that the surface speed of the rollers 13 and 15 ($s_f$) is faster than the surface speed of the winch line ($s_w$) coming off the drum. This speed can be from 10% to 300% faster. This speed is preferably from 10%-100% faster. The roller rpm cannot be fixed at one constant speed throughout the entire unspooling process. This is due to how the winch line coils up on the drum in multiple layers. The outermost layer ($r_4$) will have a much faster surface speed than the innermost layer ($r_1$) since the winch drum rpm ($rpm_w$) is constant. This means that the fairlead rollers must spin fastest at the outermost layer and sequentially slow down as it reaches the innermost layer.

It is difficult to know which wrap is being unspooled and at what point in time. A solution to change the roller speed at the correct time is accomplished through sensing the current draw of the fairlead motor 7. When unspooling, a target current draw must be maintained throughout the entire process by changing the rpm of the fairlead motor 7. If the measured current is higher than the target current, this means too much friction is being created between the rollers 13 and 15 and the line 9. In such situations, the fairlead motor 7 needs to be slowed down. If the measured current is lower than the target current, this means the line 9 is most likely not in tension. In this instance, the fairlead motor 7 needs to speed up. The target current for the system is 3-4 amps.

Figure 2:
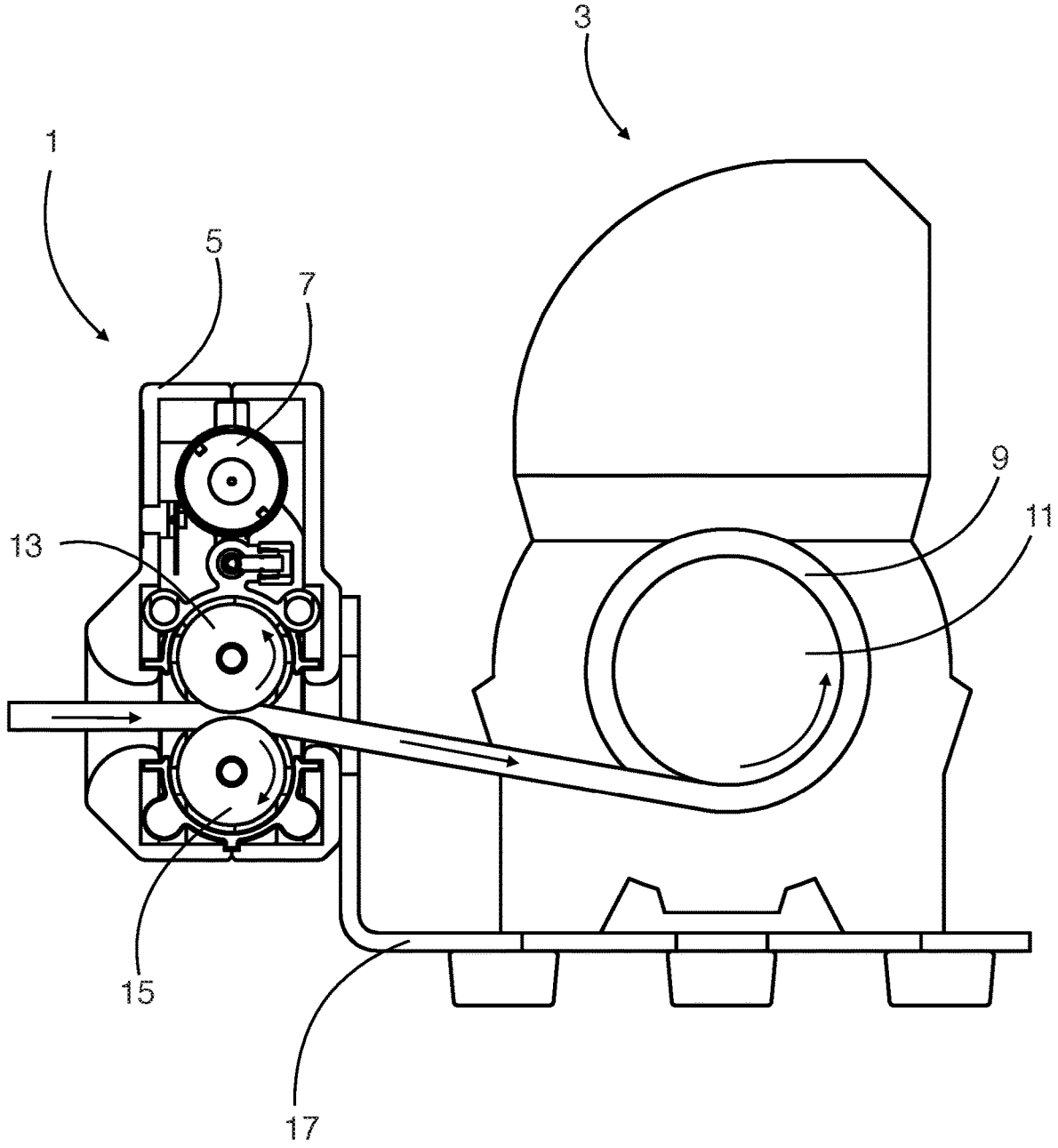
FIG. 2 is a cross-section of the fairlead attached to the winch.

As the winch drum 11 reverses direction, the line 9 is spooled onto the winch drum 11 as shown in FIG. 2. The winch 3 and fairlead 1 are both attached to a frame 17. The fairlead housing 5 attaches the fairlead 1 to the frame 17. The winch 3 has a drum 9 around which a line 11 is coiled. When the drum 11 rotates to spool the line 9 as seen by the arrow on the drum indicating the direction of rotation. The line 9 also has arrows to indicate the direction the line 9 is moving. As the line 9 is spooled onto the drum 11, it passes between the upper roller 13 and the lower roller 15 of the fairlead 1. The rollers are designed so that in some embodiments they assist in spooling the line. The fairlead 1 has a motor 7 which rotates the rollers to assist the line 9 as it spools onto the drum 11 of the winch 3.

To ensure that the rollers 13 and 15 of the fairlead 1 are assisting to spool the line onto the winch drum 11, the motor 7 of the fairlead 1 must turn the rollers so that they are spooling the line 9 in concert with the winch drum 11. The arrow on winch drum 11 indicates the direction of rotation, for the purposes of this example the winch drum 11 is moving in a counterclockwise direction to spool the line 9 onto the winch drum. The line 9 is spooling onto the drum 11 and moving away from the fairlead 1. The upper roller 13 and lower roller 15 compress the line 9. As the rollers 13 and 15 compress the line 9, they are able to keep tension on the line 9 so that it spools smoothly. To ensure that the line 9 spools smoothly the rollers 13 and 15 must rotate in the correct direction. The motor 7 of the fairlead 1 is connected to a microcontroller (not shown) which is connected to a sensor placed in the winch (not shown) to determine the direction of rotation of the winch drum 11. The sensor will be described later. The sensor communicates the direction of rotation of the winch drum 11 to the fairlead motor 7. This enables the fairlead motor 7 to rotate the rollers 13 and 15 in the correct direction to spool the line. In the present example, the upper roller 13 rotates in a counterclockwise direction, as shown by the arrow on upper roller 13. At the same time, the lower roller 15 rotates in a clockwise direction, as shown by the arrow on the lower roller 15. The rotation of the rollers 13 and 15 keep tension on the line 9 as it is spooled onto the winch drum 11.

In some embodiments, the rollers disengage when rotating in the spooling direction due to a one-way bearing. Even when disengaged the rollers still maintain the tension on the line so as to enable the line to be spooled onto the winch drum in an even and organized manner.

Figure 3:
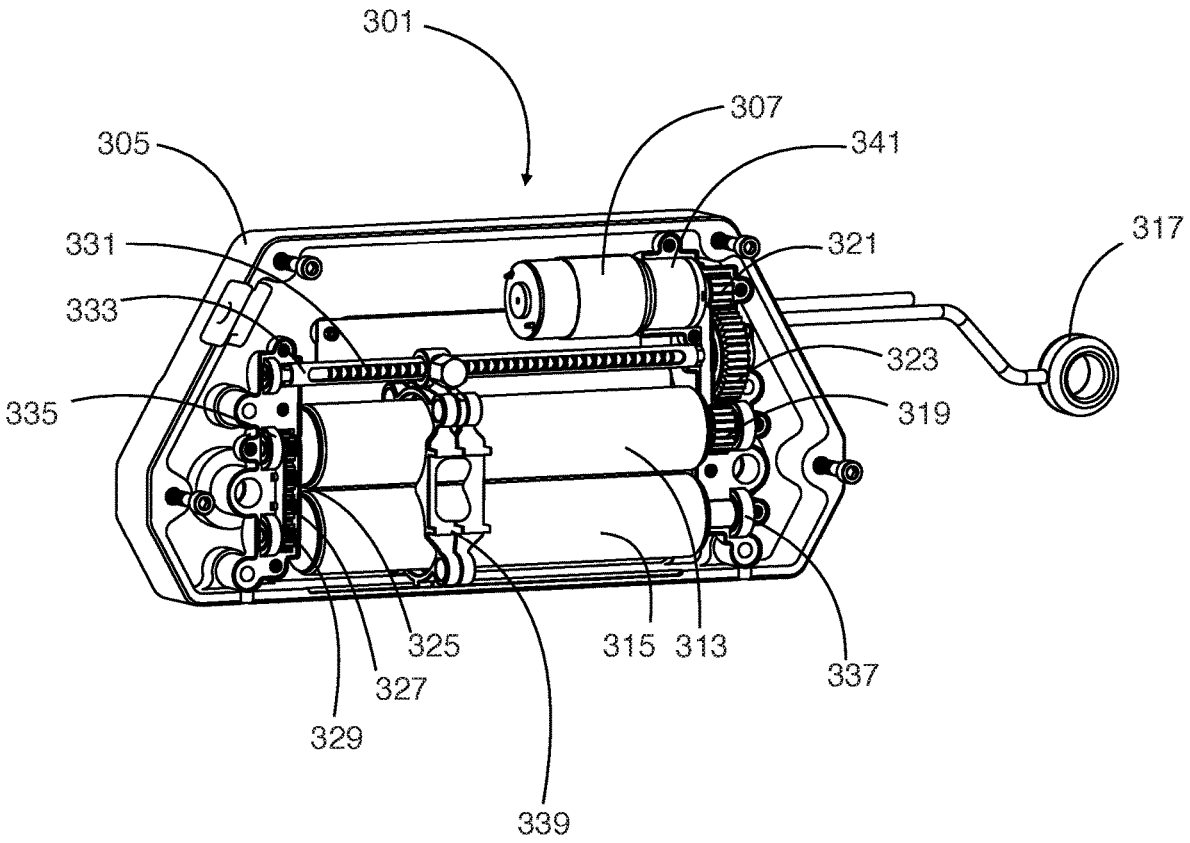
FIG. 3 is an internal view of the fairlead.

FIG. 3 is a view of the internal workings of the fairlead. The fairlead 301 integrates an automatic line coiling mechanism into the fairlead. The automatic coiling mechanism is directly geared to the fairlead motor 307. The winch line passes through the opening of the guide 339. The guide 339 directs the line as it spools onto the winch drum, to ensure organized even coiling of the line on the drum. The guide 339 travels across parallel to the axis of rotation of the drum. The guide 339 is moved by the self-reversing screw 331, which is turned by the gears 323 and 327 connected to the fairlead motor 307. As the motor 307 speeds up, the guide 339 will be moved faster. The self-reversing screw 331 enables the guide to move back and forth across the width of the rollers 313 and 315. As the line reaches one end of the winch drum, the self-reversing screw 331 will cause the guide 339 to reverse direction and coil the line over the line coiled on the winch drum. In this way, the line will be evenly coiled onto the winch drum.

The fairlead is enclosed by a housing 305. The housing is preferably made of metal. In some embodiments the metal is an aluminum alloy. In other embodiments, the housing is made from steel. Alternatively, the housing can be made from reenforced plastic composite material.

Preferably, when spooling a winch line, there will be a specific, constant motor rpm that will be used during the entire process. This differs from unspooling in that the motor rpm will not change with the varying wraps of line on the drum.

When first used the fairlead is preferably calibrated to the winch it is used with. The winch line must be spooled all the way out, and the fairlead installed. The fairlead is then entered into a calibration mode through a long press of an external calibration button. The user then spools in line for 15-20 seconds.

During this time the internal tachometer 335 is logging the rpm of the fairlead rollers 313 and 315. It is important to note that in some embodiments the fairlead motor does not control the rollers while spooling due to the one-way bearing 319 that disengages them in the spooling direction. This allows the rollers 313 and 315 to spin while spooling. The material of the rollers and the bearing 319 maintain friction on the line, which keeps the tension between the fairlead and the winch. Friction between the rollers 313 and 315 and the winch line, however, causes the rollers to rotate and the tachometer data can be directly related to the winch's drum rpm. An algorithm will then use this data to assign the fairlead motor a permanent "spooling speed" that it will record to memory and use every time the user spools in their line. Factors that make up the algorithm include the roller tachometer data, roller diameter, the self-reversing screw pitch, gear reductions, and rope diameter.

In addition to recording a fairlead motor speed variable, a "spool-down" variable will preferably be measured and recorded as well. This variable relates to how long it takes the winch drum to come to a stop after the winch remote button is released. The fairlead needs to operate during this period so that the winch line is being managed during the spool-down time.

The fairlead contains gears 321, 323, 325, 327, and 329. These gears enable the motor 307 to rotate the rollers 313 and 315 in the correct direction to assist in spooling the line onto the drum or unspooling the line from the drum. The number of gears is necessary to ensure that the rollers rotate in a coordinated direction to compress the line and pull it through the fairlead.

The fairlead includes a current sensor 317 that attaches to the wiring of the winch. The current sensor 317 detects the direction the winch motor is rotating the winch drum. This information is then communicated to a microcontroller connected to the fairlead motor 307. The microcontroller controls the fairlead motor 307 and ensures that the fairlead motor rotates the rollers in coordination with the winch drum. The fairlead measures this current using a non-contact, open-loop current sensor. This sensor is installed over one of the winch wires that supply electrical power to the winch motor.

Figure 4:
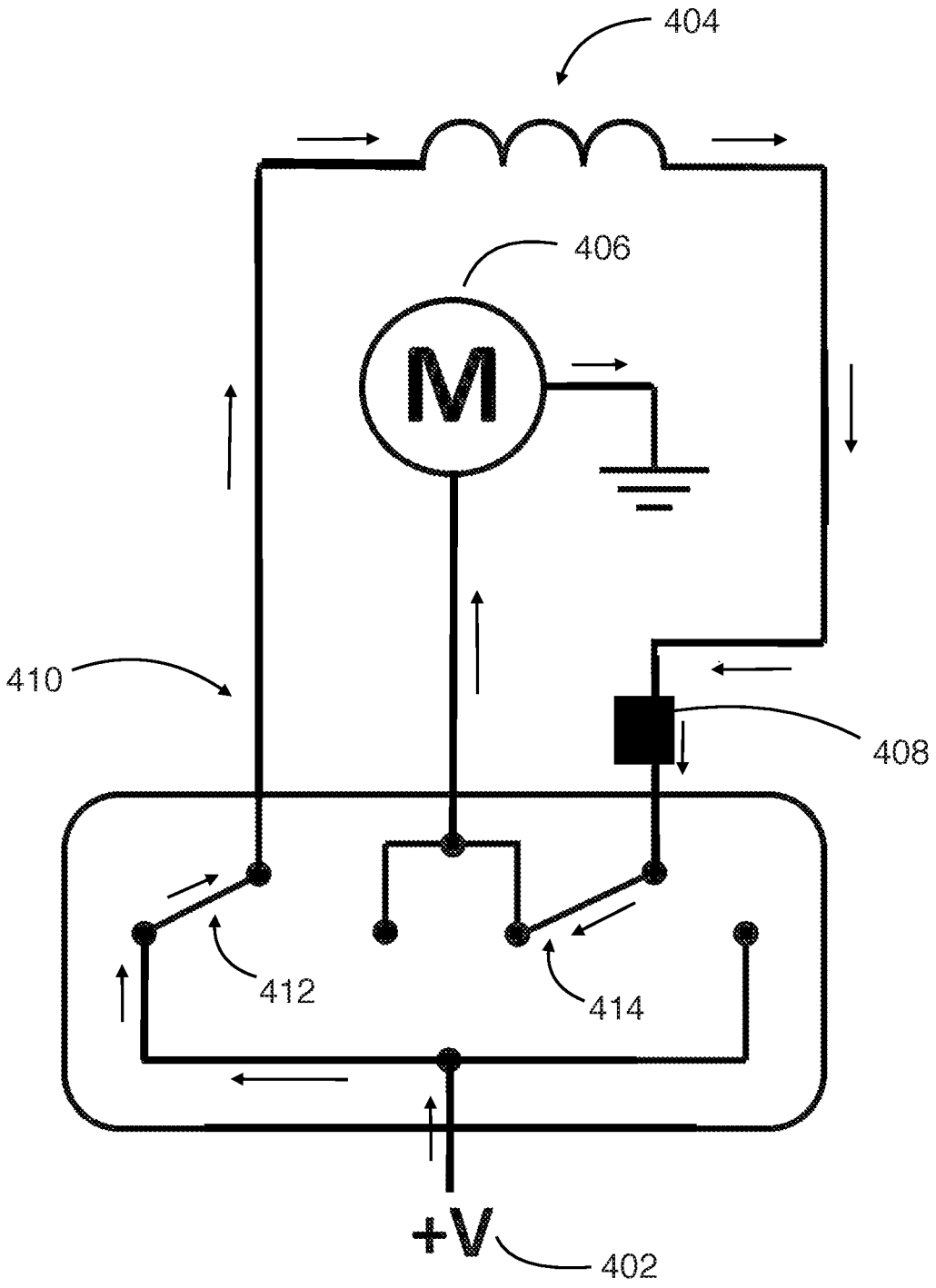
FIG. 4 is a simplified circuit diagram.
Figure 5:
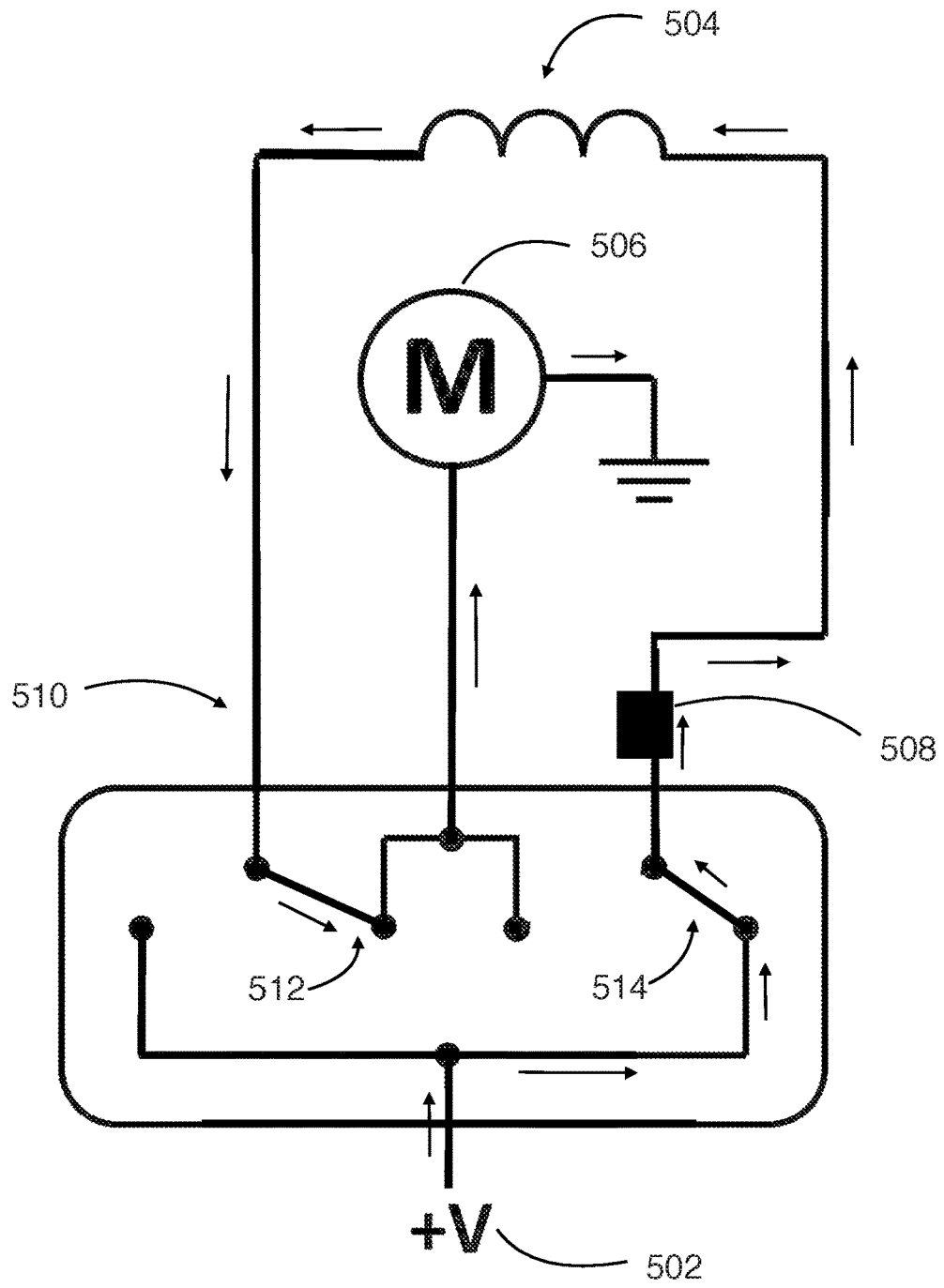
FIG. 5 is a simplified circuit diagram.

FIGS. 4 and 5 are simplified circuit diagrams detailing where to place the current sensor to allow the fairlead to sense the direction and the amplitude of the current used by the winch. FIG. 4 illustrates the flow of current for a winch as the line is unspooled from the winch drum. FIG. 5 illustrates the flow of current for a winch as the line is spooled onto the winch drum. In FIG. 4, the current flows from the battery 402 through the circuit. The current continues through switch 412 to the stator windings 404. Current continues through the current sensor 408. Then through switch 414 to the motor windings. The current through the stator windings 404 creates an electromagnetic field that interacts with the electromagnetic field of the motor windings to rotate the motor.

In FIG. 5 the current flows from the battery 502 through the circuit. The current continues through switch 514 to the stator windings 504. Current continues through the current sensor 508. Then through switch 512 to the motor windings. The current through the stator windings 504 creates an electromagnetic field that interacts with the electromagnetic field of the motor windings to rotate the motor.

In FIG. 4 the current causes the line to be unspooled from the drum. As the current passes through the current sensor, it is traveling in one direction. For the purpose of this figure it is passing down through the current sensor. The current sensor detects the direction the current is traveling. The sensor could be said to interpret this direction as a positive polarity. In FIG. 5 the current causes the motor to rotate so the line is spooled onto the drum. As the current passes through the current sensor, it is traveling in the opposite direction from the current in FIG. 4. For the purpose of this figure it is passing up through the current sensor. The current sensor detects the direction the current is traveling. As the direction the current is traveling in FIG. 5 is opposite that of the direction the current is traveling in FIG. 4, the sensor could be said to interpret this direction as a negative polarity. Even though the polarity of the current is unchanged, the change in the current path changes the direction the current travels through the current sensor.

The current sensor could also be placed in another location on the circuit. For example the current sensor could also be placed at location 410 or location 510.

The current sensor allows the fairlead to be used with any winch. In another embodiment, a winch that uses a basic or traditional style DC motor with permanent magnets will reverse the electrical polarity to change the direction of the winch motor. The current sensor is placed on the wire carrying the current to the motor to monitor the change in polarity and thus the change in the direction of the winch motor. The current sensor communicates the change in polarity to the fairlead motor.

Figure 6:
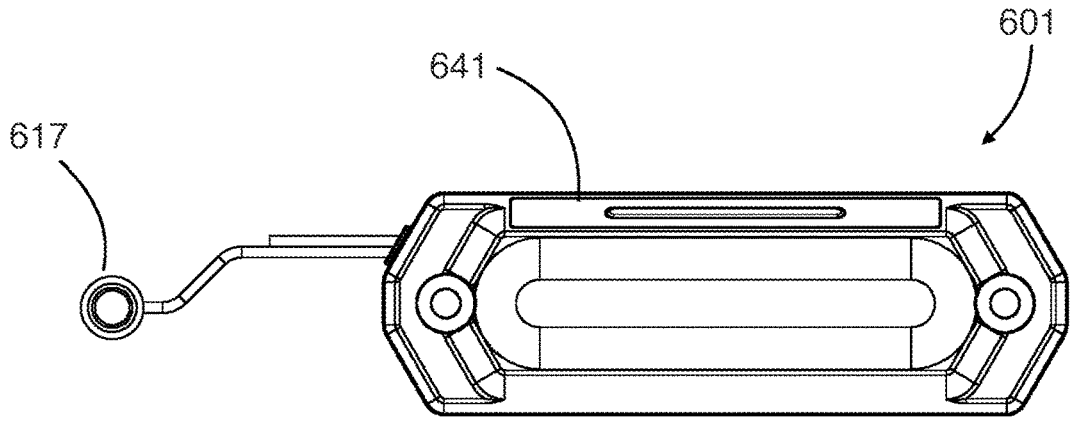
FIG. 6 is a front view of one embodiment of a fairlead.

FIG. 6 is a front view of a fairlead that visually indicates the load on a winch. The amount of current a winch draws from the battery is linearly related to the amount of weight the winch is pulling. The heavier the weight, the more power the winch requires, the more current the winch will draw from the battery. The fairlead 601 measures this current using a non-contact, open-loop current sensor 617. This sensor is installed over one of the winch wires that supply electrical power to the winch motor.

The fairlead's built-in electronics take the signal from the current sensor and output it to the light load bar 641. Preferably, the light load bar contains twelve light emitting diodes (LEDs). Alternatively, the light load bar contains as few as 3 LEDs or as many as 20 LEDs. While LEDs are the preferred lights for the load bar, other lights can be used. The LEDs are sequentially lit up from left to right as the load increases. The colors of the light emitting diodes (LEDs) also change with increasing load from green to yellow to orange to red.

Figure 7:
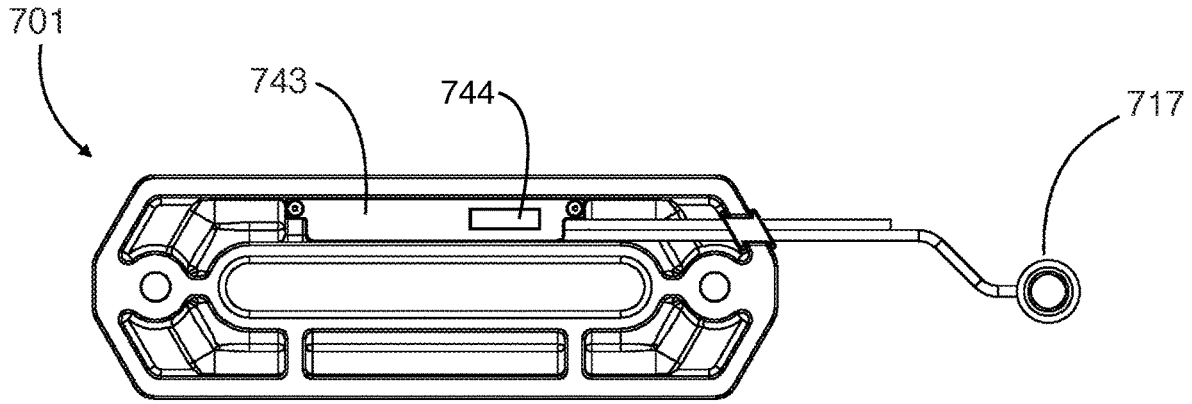
FIG. 7 is a rear view of one embodiment of a fairlead.
Figure 8:
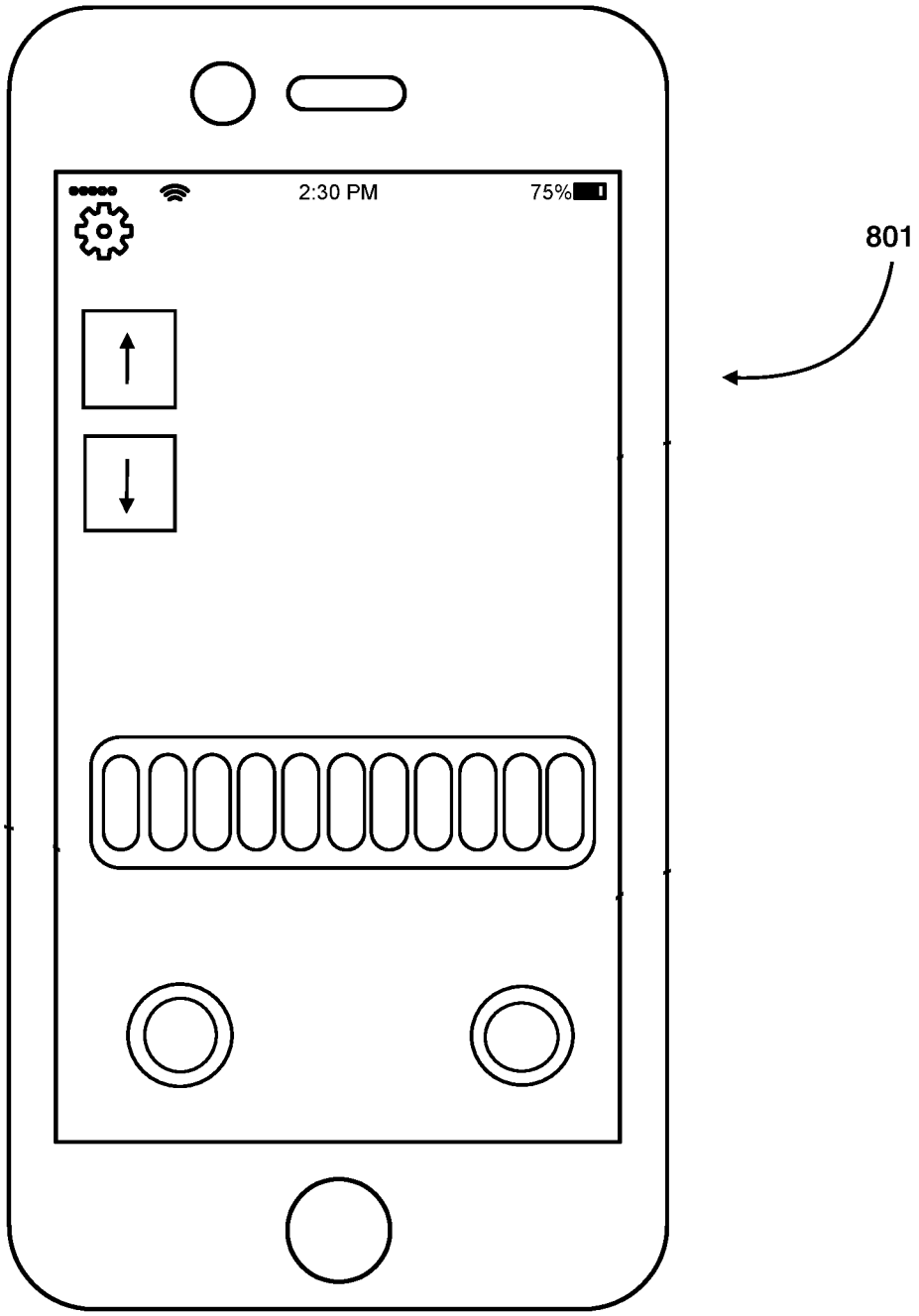
FIG. 8 is a schematic view of a device to remotely control the winch.

FIG. 7 is a rear view of a fairlead that visually indicates the load on a winch. The amount of current a winch draws from the battery is linearly related to the amount of weight the winch is pulling. The heavier the weight, the more power the winch requires, the more current the winch will draw from the battery. The fairlead 701 measures this current using a non-contact, open-loop current sensor 717. This sensor is installed over one of the winch wires that supply electrical power to the winch motor.

The fairlead's built-in electronics 743 preferably take the signal from the current sensor and output it to the light load bar. The built-in electronics preferably include a controller 744 and a printed circuit board (PCB). The controller and LEDs are preferably incorporated in the PCB.

Different makes and models of winches draw different amounts of current at their maximum rated capacity. Having a user calibrate the fairlead to their style of winch would be very difficult. Most winches that would utilize this size fairlead (trucks/jeeps) draw between 400-500 amps when at maximum capacity. Since the led bar does not display a high-resolution indicator of an exact instantaneous load, it is programmed to display maximum load at an average of 450 amps. This will give users a "ballpark" idea of how loaded their winch is.

By coordinating the actions of the fairlead to the winch, the fairlead is controlled along with the winch in many embodiments. In some embodiments, however, a remote control 801 gives users greater control over the functions of the fairlead. The remote control 801 is a stand-alone device in some embodiments. In other embodiments, the remote control 801 is an app running on a personal communication device, such as a smartphone, tablet, or laptop computer. The app for a personal communication device includes a user interface. The user interface is able to provide additional information to the user, such as load on the winch and whether the winch is spooling or unspooling.

In some embodiments, the fairlead is a mechanism to add to an existing winch. In other embodiments, the fairlead is incorporated into a winch.

All patents and published patent applications referred to herein are incorporated herein by reference. The invention has been described with reference to various specific and preferred embodiments and techniques. Nevertheless, it is understood that many variations and modifications may be made while remaining within the spirit and scope of the invention.

What is claimed is:

1. A fairlead for use with a winch comprising:

a first and second roller adapted to aid in spooling or unspooling a line; a motor for driving at least the first roller;

a sensor for determining the speed at which the rollers are rotating to aid in spooling or unspooling the line; a controller connected to the motor, and in communication with the sensor;

wherein, the sensor determines the speed at which the rollers are rotating to aid in spooling or unspooling the line;

wherein, the controller is configured to direct the motor so that at least the first roller rotates at a speed to keep tension on the line and assist in unspooling or spooling the line in coordination with the winch drum; and wherein the fairlead is calibrated to the winch it is being used with; wherein the sensor is a current sensor.

2. The invention of claim 1, wherein the motor drives both the first and the second roller.

3. The invention of claim 1, wherein the current sensor determines whether the winch drum is spooling or unspooling the line based on the direction of the current.

4. The invention of claim 1, wherein the controller is adapted to communicate with and receive commands from a remote-control device.

5. The invention of claim 4, wherein the remote-control device is a personal communication device.

6. The invention of claim 1, further comprising a guide mechanism to evenly coil the line onto the winch drum.

7. The invention of claim 1, wherein the fairlead is attached to a winch frame.

8. A fairlead for attaching to a winch comprising: a first and second roller;

a motor for driving at least the first roller;

a sensor for determining the speed at which the rollers are rotating to aid in spooling or unspooling a line; a controller connected to the motor, and in communication with the sensor;

wherein, the rollers are adapted to help unspool a line off of and spool a line onto the winch drum;

wherein, the controller is configured to control the motor to drive at least the first roller in the direction so as to pull on the line as the line is unspooling from the winch drum and to disengage the rollers when the line is spooling onto the winch drum; and wherein the fairlead is calibrated to the winch it is being used with wherein the sensor is a current sensor.

9. The invention of claim 8, wherein the current sensor determines whether the winch drum is spooling or unspooling the line based on the direction of the current.

10. The invention of claim 8, wherein the controller is adapted to communicate with and receive commands from a remote-control device.

11. The invention of claim 8, further comprising bearings connected to the at least first roller, wherein the bearings are adapted to assist the at least one roller in maintaining tension on the line between the at least one roller and the winch drum.

12. The invention of claim 8, wherein the fairlead is attached to the winch frame.

13. A winch comprising:

a winch motor;

a winch drum for spooling and unspooling a line; a fairlead comprising:

a first and second roller;

a fairlead motor for driving at least the first roller;

a sensor to determine the speed at which the rollers are rotating to aid in spooling or unspooling a line; a controller connected to the fairlead motor, and in communication with the sensor;

wherein, the sensor determines the speed at which the rollers are rotating to aid in spooling or unspooling the line wherein, the controller is configured to direct the fairlead motor so that at least the first roller rotates at a speed to keep tension on the line and assist in unspooling or spooling the line in coordination with the winch drum; and wherein the fairlead is calibrated to the winch it is being used with; wherein the sensor is a current sensor.

14. The invention of claim 13, wherein the current sensor determines whether the winch drum is spooling or unspooling the line based on the direction of the current.

15. The invention of claim 14, wherein the controller is configured to control the motor to drive at least the first roller in the direction so as to pull on the line as it is unspooling from the winch drum and to disengage the rollers when the line is spooling onto the winch drum.

16. The invention of claim 15, further comprising bearings connected to the at least first roller, wherein the bearings are adapted to assist the at least one roller in maintaining tension on the line between the at least one roller and the winch drum.

17. The invention of claim 13, wherein the controller is adapted to communicate with and receive commands from a remote-control device.

* * * * *